US005401353A

United States Patent [19]

Westbury et al.

[11] Patent Number: 5,401,353

[45] Date of Patent: Mar. 28, 1995

[54] APPARATUS AND METHOD FOR APPLYING LABELS ONTO SMALL CYLINDRICAL ARTICLES USING STATIC WIPERS

[75] Inventors: Ian Westbury, Turlock, Calif.; John M. Galchefski, Larksville, Pa.

[73] Assignee: CMS Gilbreth Packaging Systems, Trevose, Pa.

[21] Appl. No.: 76,259

[22] Filed: Jun. 11, 1993

Related U.S. Application Data

[63] Continuation-in-part of Ser. No. 906,573, Jun. 30, 1992.

[51] Int. Cl.[6] ..... B65C 9/00

[52] U.S. Cl. ..... 156/566; 156/156; 156/287; 156/568; 156/578

[58] Field of Search ..... 156/215, 256, 281, 308.6, 156/308.8, 314, 446, 449, 450, 456, 520, 521, 566, 567, 568, 578; 118/219, 258, 259, 261, 262, 326

[56] References Cited

U.S. PATENT DOCUMENTS

| | | | |
|---|---|---|---|
| 2,703,660 | 3/1955 | Von Hofe et al. | 216/55 |
| 3,006,317 | 10/1961 | Showalter | 118/262 |
| 3,235,433 | 2/1966 | Cvacho et al. | 156/229 |
| 3,577,293 | 5/1971 | Ritterhoff | 156/187 X |
| 3,604,584 | 9/1971 | Shank, Jr. | 215/12 R |
| 3,659,394 | 5/1972 | Hartleib et al. | 53/33 |
| 3,765,991 | 10/1973 | Hoffmann | 156/521 |
| 3,834,963 | 9/1974 | Hoffman | 156/256 |
| 3,878,960 | 4/1975 | Jonsson et al. | 215/12 R |
| 4,108,709 | 8/1978 | Hoffmann | 156/446 |
| 4,108,710 | 8/1978 | Hoffmann | 156/450 |
| 4,108,711 | 8/1978 | Hoffmann | 156/497 |
| 4,124,433 | 11/1978 | Herdzina et al. | 156/456 |
| 4,207,832 | 6/1980 | Bowman et al. | 118/212 |
| 4,242,167 | 12/1980 | Hoffmann | 156/357 |
| 4,271,216 | 6/1981 | Shimizu | 118/219 X |
| 4,323,416 | 4/1982 | Malthouse et al. | 156/521 |
| 4,336,095 | 6/1982 | Hoffmann | 156/361 |
| 4,366,016 | 12/1982 | Golden, Jr. | 156/218 |
| 4,406,721 | 9/1983 | Hoffmann | 156/86 |
| 4,416,714 | 11/1983 | Hoffmann | 156/86 |
| 4,425,866 | 1/1984 | Hoffmann | 118/58 |
| 4,443,285 | 4/1984 | Roth et al. | 156/215 |
| 4,447,280 | 5/1984 | Malthouse | 156/85 |
| 4,496,409 | 1/1985 | Kontz | 156/85 |
| 4,500,386 | 2/1985 | Hoffman | 156/449 |
| 4,526,645 | 7/1985 | Malthouse et al. | 156/350 |

(List continued on next page.)

FOREIGN PATENT DOCUMENTS

| | | |
|---|---|---|
| 1012906 | 6/1977 | Canada . |
| 0006505 | 1/1980 | European Pat. Off. . |
| 0375538 | 6/1990 | European Pat. Off. . |
| 1579379 | 8/1969 | France . |
| 8803874 | 6/1988 | Germany . |
| 1106653 | 3/1968 | United Kingdom . |

*Primary Examiner*—David A. Simmons
*Assistant Examiner*—James J. Engel
*Attorney, Agent, or Firm*—Morgan & Finnegan

[57] ABSTRACT

An apparatus for applying thin film polymer labels onto small cylindrical articles has a label transport drum with a substantially smooth, outer surface on which labels are fed. A cold adhesive that is viscous at room temperature is printed onto an area adjacent the leading edge of the label. A solvent is applied by two static wiper assemblies onto an area adjacent the trailing edge of the label. The first static wiper assembly wipes an amount of solvent onto the area adjacent the trailing edge of the label for cleaning and softening that area. A second wiper assembly applies an amount of solvent onto the area adjacent the trailing edge of the label for dissolving a portion of the label to create a tacky, bonding quality to the label and form a solvent seal bond when the trailing edge overlaps the leading edge. Solvent is applied to the wiper bodies for dispersion throughout and to the wiper tip. A plunger is formed in the drum at those areas where the trailing edges of labels are positioned. Each plunger is spring biased outward from the drum surface to position the trailing edge of a label at a position beyond the peripheral drum surface for engaging the wiper tips. During wrapping, the article forces the plunger downward so it will not interfere with article wrapping.

18 Claims, 8 Drawing Sheets

U.S. PATENT DOCUMENTS

| | | | |
|---|---|---|---|
| 4,544,431 | 10/1985 | King | 156/256 |
| 4,545,832 | 10/1985 | Hoffmann | 156/86 |
| 4,561,928 | 12/1985 | Malthouse | 156/497 |
| 4,574,020 | 3/1986 | Fosnaught | 156/80 |
| 4,604,154 | 8/1986 | Fosnaught | 156/264 |
| 4,632,721 | 12/1986 | Hoffmann et al. | 156/458 |
| 4,662,925 | 5/1987 | Thimons et al. | 65/104 |
| 4,671,836 | 6/1987 | Fumei | 156/215 |
| 4,686,931 | 8/1987 | DiFrank | 118/50 |
| 4,693,210 | 9/1987 | DiFrank | 118/259 |
| 4,694,633 | 9/1987 | Fujio et al. | 53/49 |
| 4,704,173 | 11/1987 | Hoffman | 156/86 |
| 4,724,037 | 2/1988 | Olsen | 156/578 |
| 4,726,872 | 2/1988 | Olsen | 156/455 |
| 4,729,811 | 3/1988 | DiFrank | 156/449 |
| 4,735,668 | 4/1988 | Hoffmann | 156/215 |
| 4,749,428 | 7/1988 | Dickey | 156/215 |
| 4,758,300 | 7/1988 | King et al. | 156/357 |
| 4,761,200 | 8/1988 | Szeremeta | 156/448 |
| 4,772,354 | 9/1988 | Olsen et al. | 156/578 |
| 4,781,785 | 11/1988 | Szeremeta | 156/448 |
| 4,832,774 | 5/1989 | DiFrank et al. | 156/215 |
| 4,844,760 | 7/1989 | Dickey | 156/215 |
| 4,844,957 | 7/1989 | Hoffman | 428/34.7 |
| 4,888,980 | 12/1989 | DeRome | 73/49.2 |
| 4,911,994 | 3/1990 | Will et al. | 429/167 |
| 4,923,557 | 6/1988 | Dickey | 156/86 |
| 4,929,312 | 5/1990 | Westcott | 203/2 |
| 4,931,122 | 6/1990 | Mitchell | 156/215 |
| 4,977,002 | 12/1990 | Hoffman | 428/34.7 |
| 4,984,413 | 1/1991 | Cosmo | 53/465 |
| 5,037,499 | 8/1991 | Bright et al. | 156/456 |
| 5,045,140 | 9/1991 | Dickey | 156/215 |
| 5,078,826 | 1/1992 | Rogall | 156/451 |
| 5,091,040 | 2/1992 | Otruba | 156/566 |
| 5,091,239 | 2/1992 | Przeworski et al. | 428/195 |
| 5,116,452 | 5/1992 | Eder | 156/566 |

APPARATUS AND METHOD FOR APPLYING LABELS ONTO SMALL CYLINDRICAL ARTICLES USING STATIC WIPERS

This application is a continuation-in-part application of U.S. patent application Ser. No. 07/906,573, filed Jun. 30, 1992, entitled "Apparatus and Method For Applying Labels Onto Small Cylindrical Articles", the disclosure which is hereby incorporated by reference.

FIELD OF THE INVENTION

This invention relates to an apparatus and method for applying labels onto cylindrical articles and more particularly to an apparatus and method for applying by wrap around labeling heat shrinkable, thin film polymeric labels onto small cylindrical articles such as dry cell batteries.

BACKGROUND OF THE INVENTION

In copending parent patent application Ser. No. 07/906,573, filed Jun. 30, 1992, small articles such as dry cell batteries, lipstick containers, lip balm containers and the like are labeled with high quality, thin film polymeric labels. Labels are fed to a label transport drum, which includes a fixed, cylindrically configured hub, and a cylindrically configured drum rotatably mounted on the hub. The drum has an outer surface on which labels are fed as a strip, and moved with the drum through a label drag area where the label strip is cut into labels of predetermined size.

As the label moves with the rotating drum, an adhesive is printed onto the area adjacent the leading edge of the label and a predetermined amount of solvent is evenly wiped onto the area adjacent the trailing edge of the label so as to dissolve partially the surface of the label and form a tacky bond. The label moves to an article wrapping position where the articles, such as dry cell batteries, are wrapped, securing first the leading edge to the article, followed by overlapping the trailing edge onto the leading edge so that the trailing edge solvent creates a solvent-seal bond. The labels are then heat shrunk over the articles. The apparatus provides for high quality cylindrical labeling of small articles such as dry cell batteries using thin film, polymeric labels, e.g., typically less than 0.0035 inches thickness.

As disclosed in the copending, parent application, new and surprising results are obtained in solvent application when a speed differential is produced between a rotating, flexible wiper tip and a label moving on the label transport drum. The speed differential between the wiper tip and the label causes application of a "bead" of solvent at the point of departure of the wiper from the label, at a point adjacent to, but spaced from the trailing edge of the label. If the wiper is moving slower than the surface speed of the label transport drum, the solvent is wiped toward the trailing edge of the label. If the wiper is moving faster than the surface speed of the label transport drum, the solvent is wiped from the trailing edge forward. As the article rolls back over the solvent during wrapping, the weight of the article pushes the solvent evenly across the pretreated area of the trailing edge on which the solvent was applied, thus in essence obtaining a more even solvent wipe along the trailing edge of the label.

Typically, the applied solvent, such as THF or other similar solvents, is more viscous than water. As the wiper tip rotates at high operating speeds, the solvent sometimes may splash onto the area adjacent the trailing edge of the label giving a mottled appearance to the trailing edge and forming a poor seam between overlapping portions of the label. It is therefore desirable to apply the solvent by a means other than a rotating wiper.

Additionally, as disclosed in the parent application, the wiper engages a gravure roller. The gravure roller receives solvent from another solvent pad or a solvent dip bath. This system has three or more transfer points which may create inaccuracies and imprecise solvent transfer.

A static wiper positioned adjacent the peripheral drum surface would eliminate splashing caused by rotation and reduce the number of transfer points. A static wiper, however, is fixed adjacent the drum surface, and unless some means is provided for biasing the trailing edge outward from the drum surface, the static wiper would not adequately engage the trailing edge of the label for solvent transfer.

U.S. Pat. No. 4,844,760 to Dickey discloses a static wiper and a fixed protrusion on the surface of a label transport drum which spaces the trailing edge of the label outward from the periphery of the drum so that the trailing edge engages the wiper tip. However, if smaller articles are used such as dry cell batteries, the article would roll up and over the protrusion, resulting in poor quality wrapping. It has been found that any protrusion that moves the trailing edge outward should also move inward during article wrapping to prevent interference between the article, the label and the drum surface.

Also, it has been found that labels sometimes are unclean and contain contaminants on the surface which cause 1) poor solvent application, 2) poor solvent penetration resulting in mottling, and 3) poor seam quality and wrap quality. It is therefore desirable to clean the trailing edge of the label before sufficient solvent is applied onto the label for complete solvent penetration and solvent-seal bonding. Additionally, the cleaning step should act as a pretreating step, softening the label in preparation for complete solvent application and penetration. Such requirement will also mandate precise metering of solvent.

SUMMARY OF THE INVENTION

It is therefore an object of the present invention to provide an apparatus and method for applying heat shrinkable thin film polymer labels onto small cylindrical articles where the trailing edge of the label is first cleaned and softened before sufficient solvent is applied onto the area adjacent the trailing edge of the label that penetrates and dissolves the label and forms a tacky-quality bonding surface.

It is another object of the present invention to provide an apparatus and method for applying heat shrinkable thin film polymer labels onto small, cylindrical articles where a portion of the label can be biased outward from the drum surface for engaging a static wiper positioned adjacent the surface of the drum and then moved inward and coextensive with the drum surface at an article wrapping position to prevent interference between the label, article and drum surface.

It is another object of the present invention to provide a wiper assembly for applying a predetermined amount of solvent onto a thin film material such as a label which includes a static wiper body having an outwardly extending wiper tip adapted for engaging a label where the amount of solvent that reaches the wiper tip is metered so as to regulate the amount of solvent applied onto the label such as for cleaning the label or dissolving a portion of the label to form a solvent-seal bond.

These and other objects and advantages of the invention are set forth in the description which follows and, in part, will be obvious from the description and advantages being realized and entertained by means of the instrumentation, facts, apparatus, systems, steps and procedures, as particularly pointed out in the specification.

In accordance with the present invention, labels formed from heat shrinkable, lightweight, thin film, polymeric sheet material are applied onto small cylindrical articles such as dry cell batteries, while obtaining well-defined, high quality seams between overlapping leading and trailing edges of the label. An adhesive is applied onto an area adjacent the leading edge of the label while the label is moving with the label transport drum. A predetermined amount of solvent is evenly applied onto the area adjacent the trailing edge of the label to partially dissolve the solvent treated area and form a tacky-quality bonding surface. Articles are conveyed in tangential spinning engagement with the label transport drum. As the drum rotates, the leading edge of the label engages an article at an article wrapping position and the adhesive retains the leading edge to the article. As the article rotates, the label wraps around the rotating article, and the trailing edge overlaps the leading edge and forms a solvent-seal bond so that the solvent secures the label in its wrapped condition to the article. The article is then heated to heat shrink the label onto the article.

In accordance with the present invention, a static wiper assembly has a porous wiper body with a fixed, outwardly extending wiper tip positioned adjacent the peripheral surface of the drum. A static wiper creates maximum speed differential between the label moving with the label transport drum and the wiper tip because the wiper is static (nonmoving) and engages a moving surface (the trailing edge of the label).

The label transport drum includes means for biasing the trailing edge of the label outwardly from the drum surface for engaging the wiper tip as the label moves with the drum. In one embodiment, the biasing means comprises a spring biased plunger extending into the drum. The plunger is biased outward from the drum surface, moving the trailing label edge outward from the drum surface to engage the wiper tip. During article wrapping, the plunger is retracted so that the article rolls on a substantially smooth surface.

In a preferred embodiment, the wiper body is supported on a substantially planar support surface formed in a cut-out of a support block. The support surface has collection means in the form of a solvent channel for collecting solvent from the wiper body. A pump delivers solvent from the reservoir onto the wiper body. A return line is connected to the solvent channel and reservoir for returning solvent to the reservoir.

Means draws a vacuum within the enclosed reservoir and regulates the subatmospheric pressure within the reservoir for controlling solvent saturation in the wiper body. In one embodiment, the vacuum and vacuum regulating means comprises a venturi, means for blowing air through the venturi, and a vacuum take-off line extending from the venturi to the closed solvent reservoir so that subatmospheric pressure within the closed reservoir varies depending on the amount of air flowing through the venturi.

In a preferred embodiment, a first wiper means wipes an amount of solvent onto the area adjacent the trailing edge of the label for cleaning and softening the area adjacent the trailing edge. A second wiper means is positioned after the first wiper means in the direction of drum rotation and applies an amount of solvent onto the area adjacent the trailing edge of the label for dissolving a portion of the label adjacent the trailing edge of the label and forming a tacky quality to the solvent applied area to form a solvent-seal bond after the article is wrapped. The solvent applied by each wiper can be the same as or different from each other. The solvent in the first wiper can be a solvent having the characteristics of clearing, while the solvent in the second wiper has characteristics of dissolving the polymer label for later forming a solvent-seal bond.

In one preferred embodiment, label retaining insert plates and surface inserts are positioned on the drum surface. Each insert has a resilient surface for engaging the label and allowing slight deflection of the article into the resilient material during article wrapping. The resilient material is formed from a soft, cushion-type material such as rubber which allows deflection of the article to create a "footprint" in the soft cushion material, squeezing the air out between the label, article, and drum surface, allowing better wrapping of the label about the article. Additionally, the resilient material increases friction between the article, label and drum surface, thus reducing the amount of pressure that is applied to the articles during wrapping. The inserts form a continuous resilient surface around the drum periphery so that labels and articles always engage the surface.

In a preferred embodiment, the label is fed as a strip into an off-drum cutting system which cuts the strip into labels at the margin between printed indicia defining the labels, and then transfers the cut labels onto the label transport drum. In another embodiment, the labels can be fed as a strip material onto the drum surface and then cut thereon.

DESCRIPTION OF THE DRAWINGS

The foregoing and other objects and advantages of the present invention will be appreciated more fully from the following description, with references to the accompanying drawings in which.

DETAILED DESCRIPTION OF THE INVENTION

Figures 1, 1A:
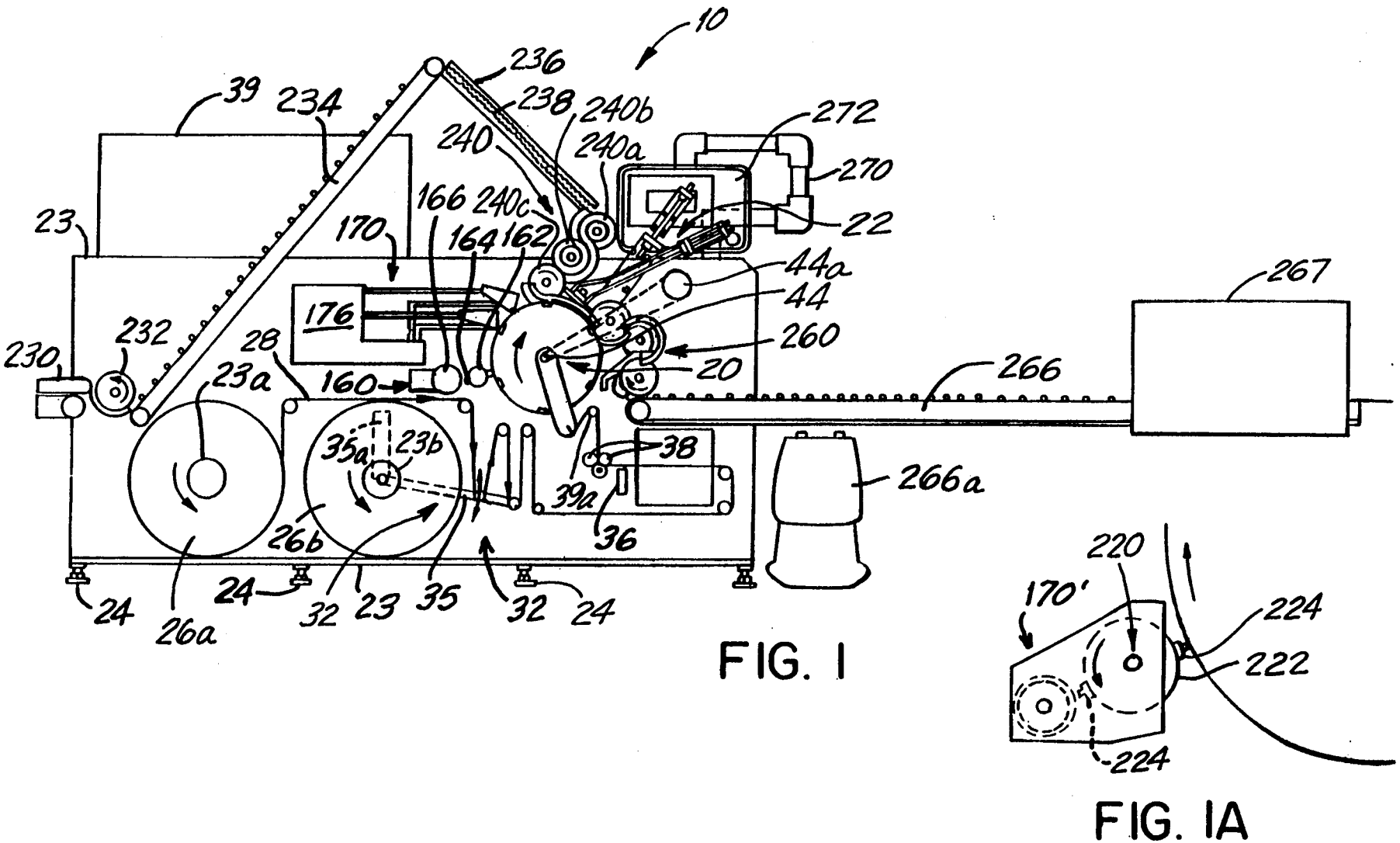
FIG. 1 is a schematic, side elevation view of the apparatus that applies labels onto small cylindrical articles in accordance with the present invention.
FIG. 1A is a schematic illustration of a wiper assembly mounted for rotation adjacent the label transport drum.

Referring now to FIG. 1, there is illustrated at 10 a schematic illustration of the apparatus for applying high quality, heat shrinkable, thin film polymeric labels to small cylindrical articles such as dry cell batteries while forming seams of high quality. Throughout this description and in the drawings the labels will be referred to by the letter "L." The apparatus 10 is suitable for high quality cylindrical labeling of small cylindrical articles such as dry cell batteries requiring thin labels with a thickness typically less than 0.0035 inches. Throughout the description and drawings, the small cylindrical articles to be labeled will be referred to as articles, and will be given the reference letter "A".

The apparatus 10 may be used for wrapping a label around a large variety of different small articles A requiring high quality labels, such as dry cell batteries, lip balm containers, lipstick tubes and other similar articles. Such high quality labeling requires end-to-end label alignment on the articles A without mismatching, so that different colored zones, lettering, and trade logos printed on the label are aligned correctly after the article is wrapped. A pressure applicator, indicated at 22, provides a biasing force against the articles during wrapping, and has means for changing the biasing force exerted against selected sides of the article so as to ensure correct label alignment.

The present invention provides a static wiper assembly which gives a maximum speed differential between the wiper tip and trailing edge of a label to provide for precise solvent application onto the label. The solvent wiper assembly includes means in the form of a reservoir and scavenge vacuum system for metering a precise amount of solvent to the wiper tip for solvent transfer onto the label.

Additionally, the construction of the label transport drum 20 of the present invention provides proper control over label retention, label movement with the drum, leading edge label transfer to an article at an article wrapping position, (indicated generally at 21, FIGS. 1 and 2), and label blow-off necessary to insure high quality labeling of small cylindrical articles such as dry cell batteries with heat shrinkable, polymeric film labels.

Figure 11A:
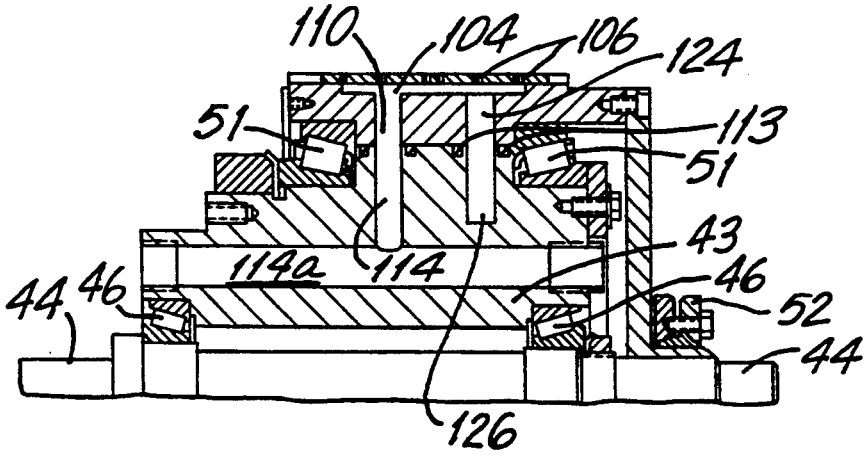
FIG. 11A is a partial sectional view of the label transport drum showing relative orientation of the label drum and hub and first and second vacuum manifolds.
Figure 11:
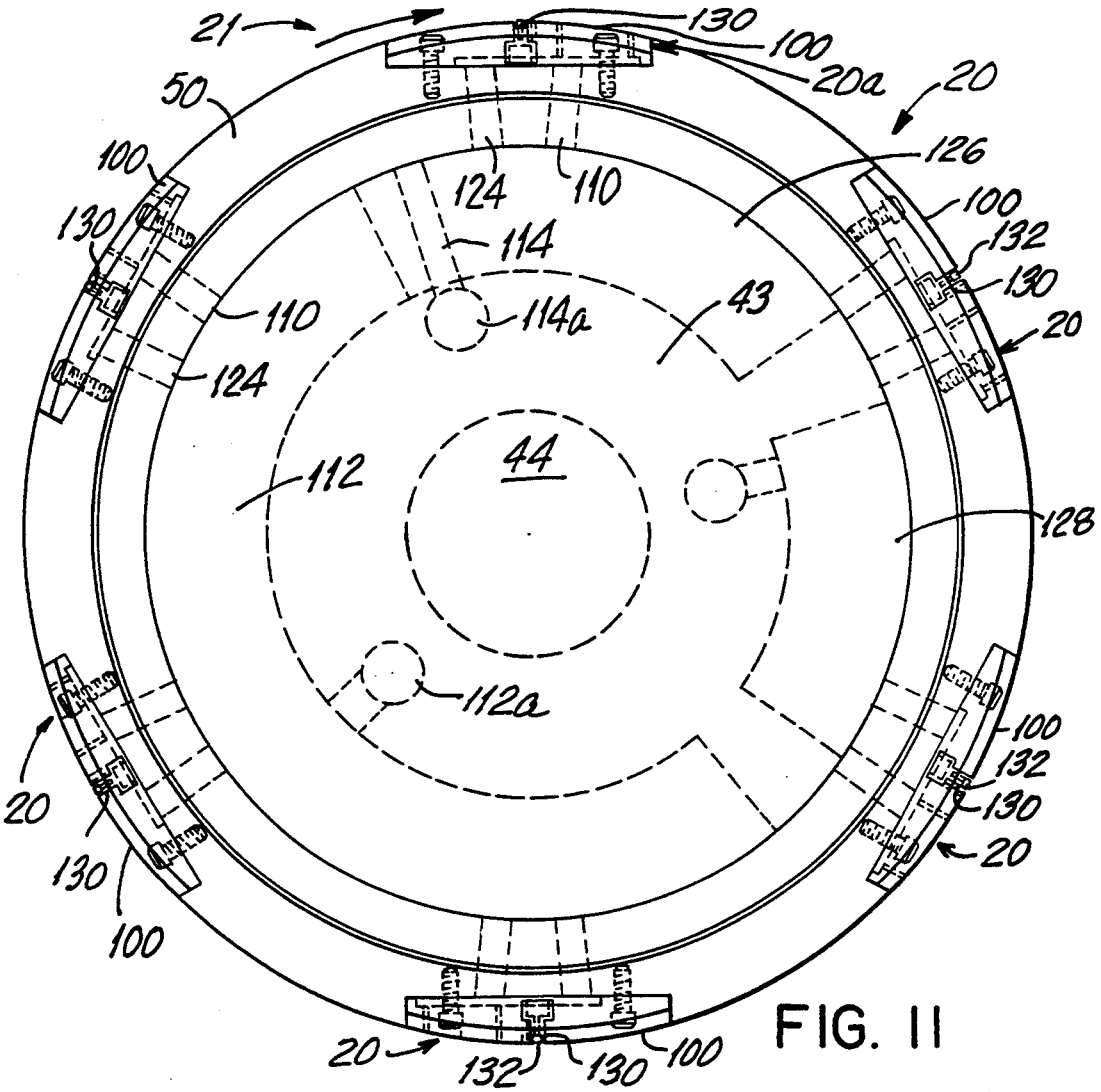
FIG. 11 is a schematic side sectional view of the label drum having six label retaining insert plates and six surface plates positioned along the outer surface of the drum and showing relative positions of vacuum and pressure manifolds.
Figure 12:
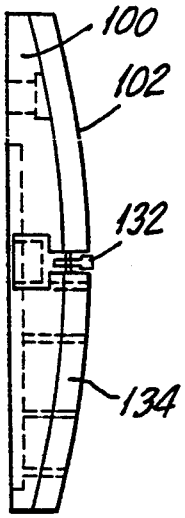
FIG. 12 is a side elevation view of a label retaining insert plate.

The label transport drum in the illustrated embodiment is a six pitch drum of about 54 inch circumference and has six label receiving positions **20*a* whose medial portions are spaced about nine inches apart (FIG. 11**). This configuration is beneficial for use with labels that are about four and a half inches or less long, corresponding to labels for wrapping dry cell batteries that are "D" size or less. For purposes of understanding and description, the size of the articles are described relative to an "AA" size battery, (slightly greater than 0.5 inch diameter and about two inches long).

In accordance with the present invention, the apparatus 10 includes a frame 23 for supporting major components such as the label transport drum, adhesive and solvent applicators, and rolls of continuous label material. The frame 23 includes leg supports 24 for supporting the frame on the floor. Two rolls **26*a*, 26*b* of label material are supported for rotation on the frame 23. The frame 23 supports an unwind drive motor and dual spindles 23*a*, 23*b***. The unwind motor is operatively connected to the spindles by suitable transmission means. The unwind motor unwinds the film and provides tension to the film as the film is withdrawn to prevent slack buildup during operation. When one supply roll is in use, the other provides a reserve roll which is used when the other roll is depleted.

Figure 16:
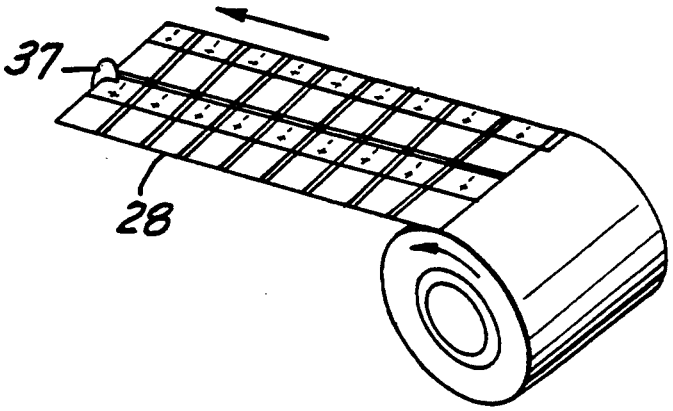
FIG. 16 is a pictorial view of a dual printed roll of label material used for labeling dry cell batteries.

The label material is pre-printed with identifying indicia used on the label that is subsequently transferred to the article A (FIG. 16). Alternatively, a printing stamp or roller (not shown) may be positioned adjacent the label roll for printing directly onto the label material as it is withdrawn from the supply roll.

Figure 14A:
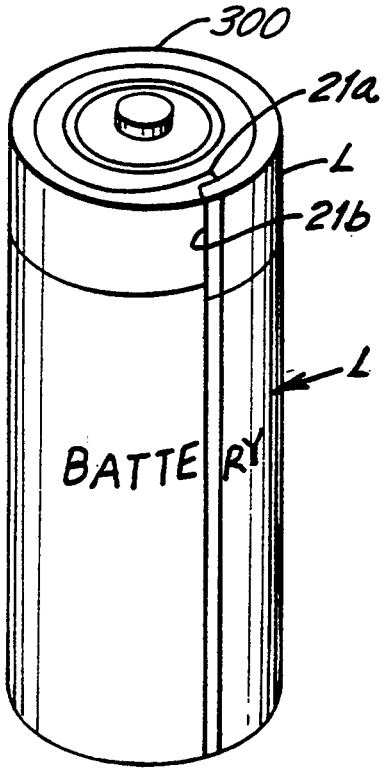
FIG. 14A is a pictorial view of a dry cell battery showing an improperly aligned label applied thereto.
Figure 14B:
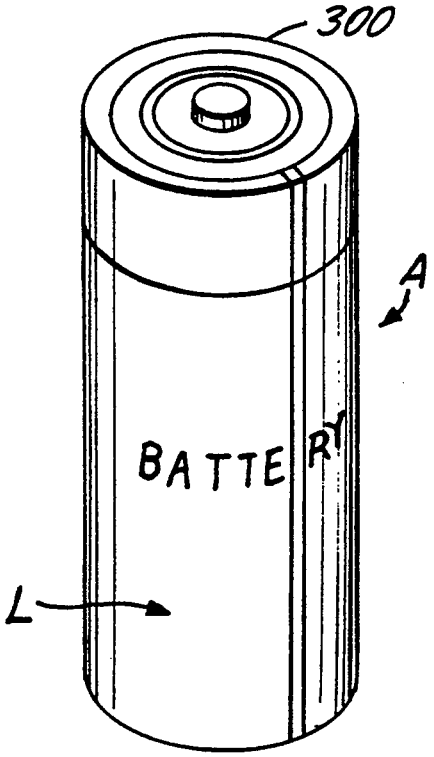
FIG. 14B is pictorial view of a dry cell battery showing a properly matched and aligned label.
Figure 15:
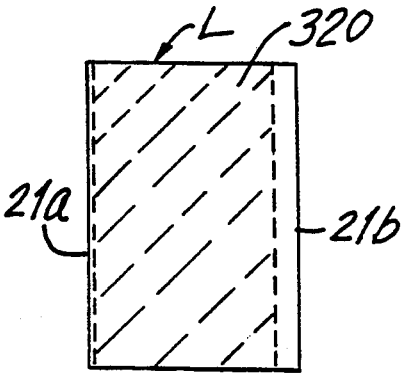
FIG. 15 is a plan view of a label to be applied, showing schematically the leading and trailing edges and the areas adjacent such areas where printed matter, and adhesives and solvents are applied.

The present illustrated apparatus 10 may be constructed for wrapping articles fed in parallel pairs to each other. In this illustrated embodiment, each strip 28 of label material has first and second continuous columns of printed indicia (FIG. 16). During labeling, the strip 28 is longitudinally slit by a conveniently positioned slitter knife 37, and then horizontally slit as will be explained later to form cut labels of predetermined size having leading and trailing edges **21*a*, 21*b* respectively (FIGS. 14A, and 14B, and 15). Although FIG. 16** shows a roll of label material designed for dual article, side-by-side wrapping, the other drawings and description follow by describing a single feed of articles and label film material. A single or a dual, parallel, side-by-side feed has no impact on the operation of the apparatus in accordance with the present invention. A dual, side-by-side feed, does, however, provide a greater production capacity to the apparatus.

The label material is preferably formed from a heat shrinkable, thin polymer film material. Examples of acceptable film materials include those formed from polyvinyl chloride, polyester, and polystyrene. The label material typically has a thickness under 0.0035 inches, a thickness corresponding to the thinner material thickness commonly used for labeling smaller cylindrical articles such as dry cell batteries, lip balm and other similar containers. Typically, the articles to be used with the present apparatus are about 1.75 inches in diameter or less corresponding to the diameter of a "D" size (about 1.5 inches diameter) or smaller dry cell battery.

Because of the demanding label and seam quality requirements necessary for labeling these types of small articles, the labels L heretofore have been pre-seamed on a continuous basis, and then applied as a sleeve to the article. With conventional sleeve technology where the sleeve is first formed on a mandrel and then transferred to an article, a typical article size ranged in size usually less than one to two inches diameter and typically less than 1.5 inches diameter. Thus, heretofore, smaller articles, such as the described dry cell batteries, had to be used as a mandrel and a sleeve placed thereover, or some other nonwrap around labeling method used.

As indicated in FIG. 1, label material is fed as a strip 28 from the first supply roll 26*a* into a festooned dancer roll assembly indicated generally at 32, having a plurality of individual dancer rolls 34 connected to a dancer arm 35. A potentiometer 35*a* is linked to the pivot of the dancer arm and controls the speed of the unwind motor. As the dancer arm 35 is raised, the potentiometer causes the unwind motor to rotate at a faster rate of speed to feed out more film to the dancer roll assembly. This causes the dancer arm assembly to drop to a lower position, thereby slowing the unwind motor.

The strip 28 passes through a registration sensor 36, such as a fiber optic sensor, registering the amount of label strip 28 withdrawn from the supply rolls 26*a*, 26*b*. Typically, the registration sensor 36 detects light-dark areas corresponding to 1) printed and 2) nonprinted areas forming the margin between respective printed labels. An automatic splicer 37 may be incorporated into the film feed line to splice the film into the two separate strips.

The strip 28 passes through a pair of feed rolls 38 rotating upwardly and outwardly from each other to aid in pulling the strip through the dancer roll assembly 32. The feed rolls 38 are rubber coated and powered by a closed loop A.C. Servomotor System. The Servomotor System feeds film at a rate that is proportional to the rate of speed of the label transport drum. This is accomplished through a position feedback incremental encoder mounted on the label transport drum drive shaft 44. As the label transport drum rotates, the encoder feeds back positional information to the servo motor amplifier via a controller 39 (FIG. 1) contained in a housing.

Figure 10A:
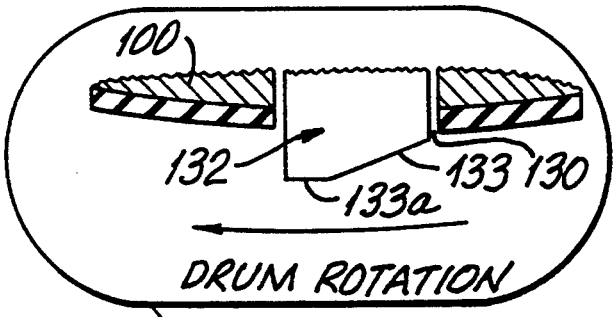
FIG. 10A is an enlarged view of the spring biased plunger used for biasing the trailing edge of the label outward from the periphery of the drum surface.
Figure 10:
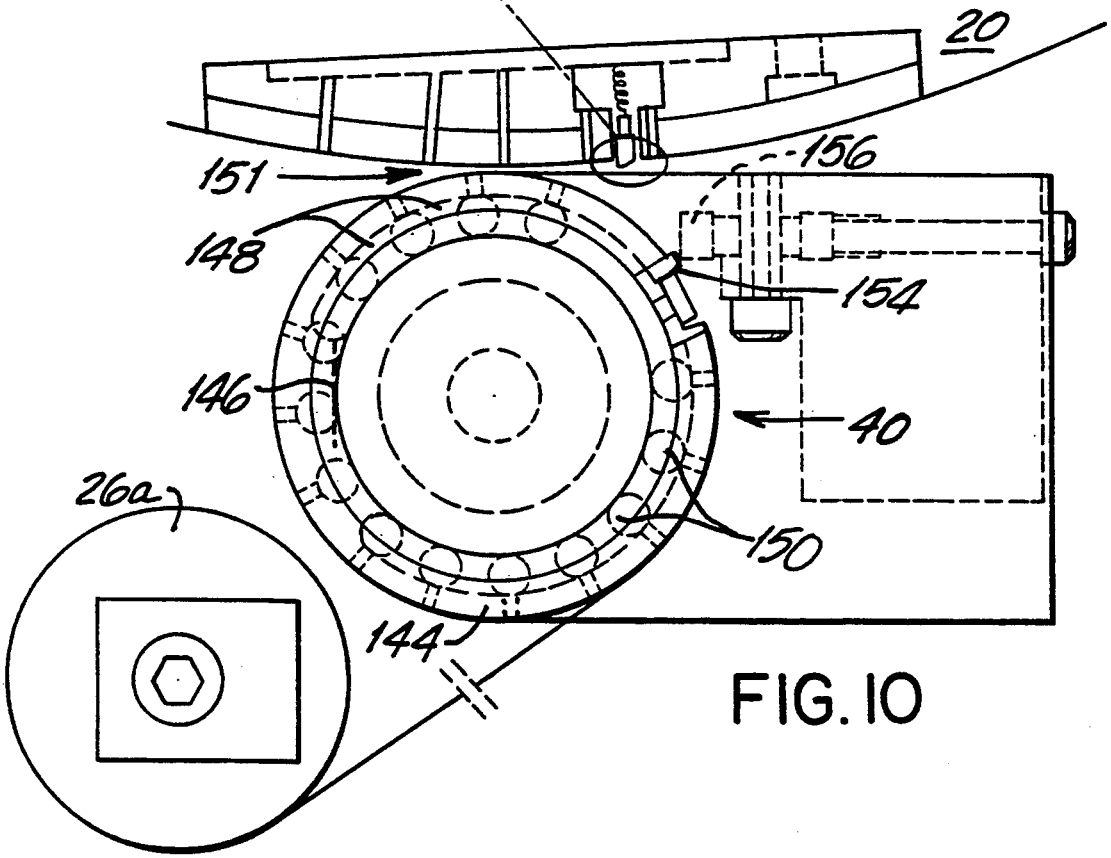
FIG. 10 is a schematic side elevation view of the off-drum cutting assembly which uses a cutting drum having alternate vacuum and pressure application for retaining and then transferring a label.

The strip 28 passes over an idler roll 39*a* and into a cutting assembly where the film is cut into labels by means of a separate cutting drum and knife assembly, indicated at 40 (FIG. 10). The cut labels are then transferred onto the label transport drum 20. The labels are small, no longer than about four inches, corresponding to the range of label sizes which would be used to label conventional dry cell batteries such as "AAA" through "D" sizes. In this description the labels are sized for wrapping about AA size batteries. Drive motors and transmission (not shown in detail) impart the force necessary for rotating the drum 20 at a desired speed.

In accordance with one embodiment, the label transport drum 20 includes an internal, cylindrically configured hub 43 secured directly to the machine frame 23 (FIG. 11). A drive shaft 44 (FIGS. 2, 11 and 11*a*) passes through the hub and is rotatably mounted by bearings 46 positioned in the hub. A cylindrically configured label drum 50 is mounted for rotation on bearings 51 about the hub (FIG. 11). The drive shaft operatively connects to the label drum 50 by a suitable coupling assembly 52 so that as the shaft is rotated, the label drum 50 rotates about the hub. A drive motor, and more preferably a servomotor, 44*a* is operatively connected to the drive shaft 44 for rotating the drum 50 (FIG. 1).

As shown in FIG. 11, the label transport drum 10 of one embodiment includes six evenly spaced label retaining insert plates 100 for receiving thereon the labels. The label transport drum typically is formed from steel construction and has cut-outs dimensioned to receive the label retaining insert plates. The label retaining insert plates 100 are formed from steel or other rigid, high strength material that can resist the high speed impact of batteries and other small articles as they are fed onto the drum and insert plates.

Figure 2:
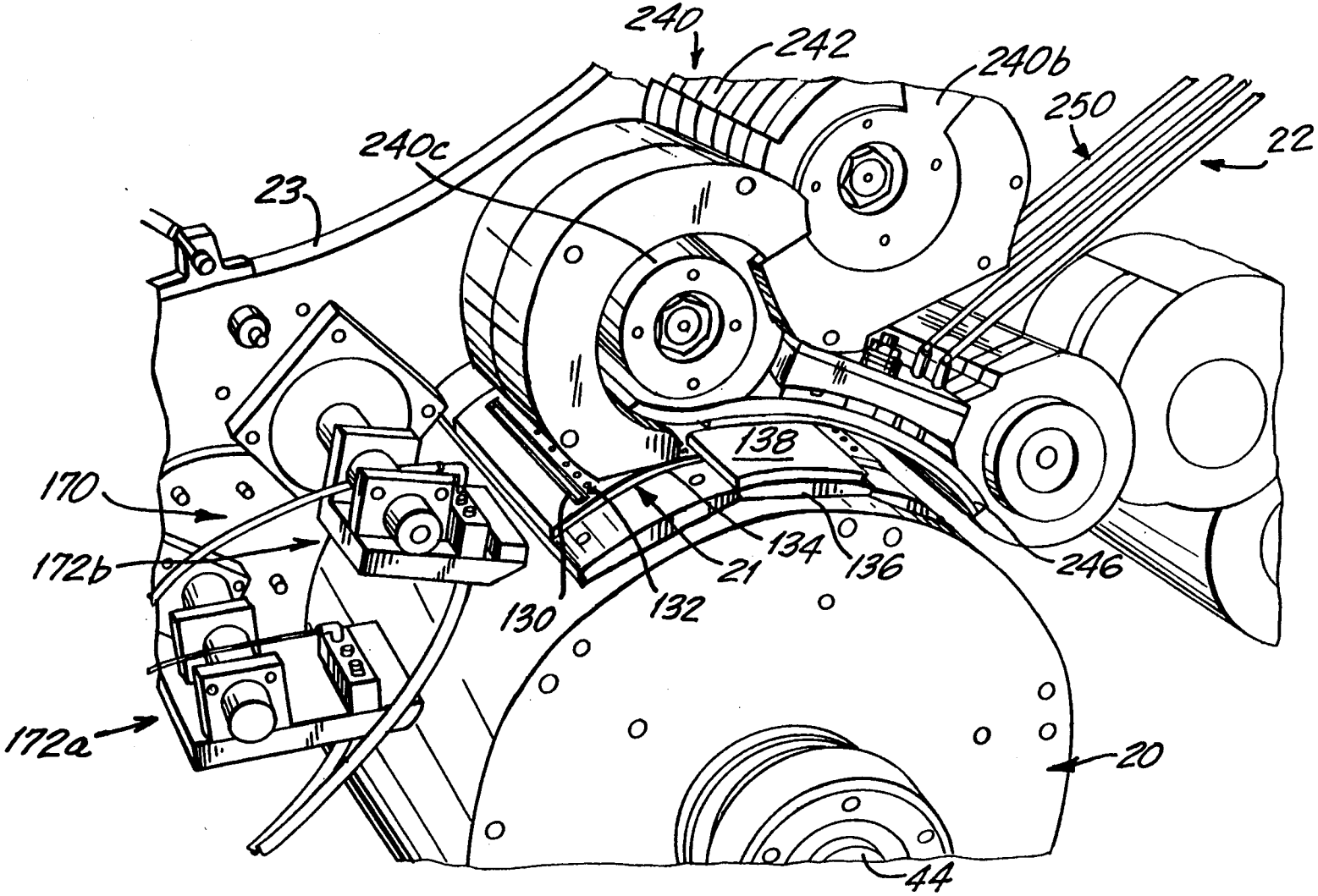
FIG. 2 is a schematic, pictorial view of one embodiment of the label transport drum showing the dual static wiper assemblies positioned adjacent the surface of the drum.
Figure 3:
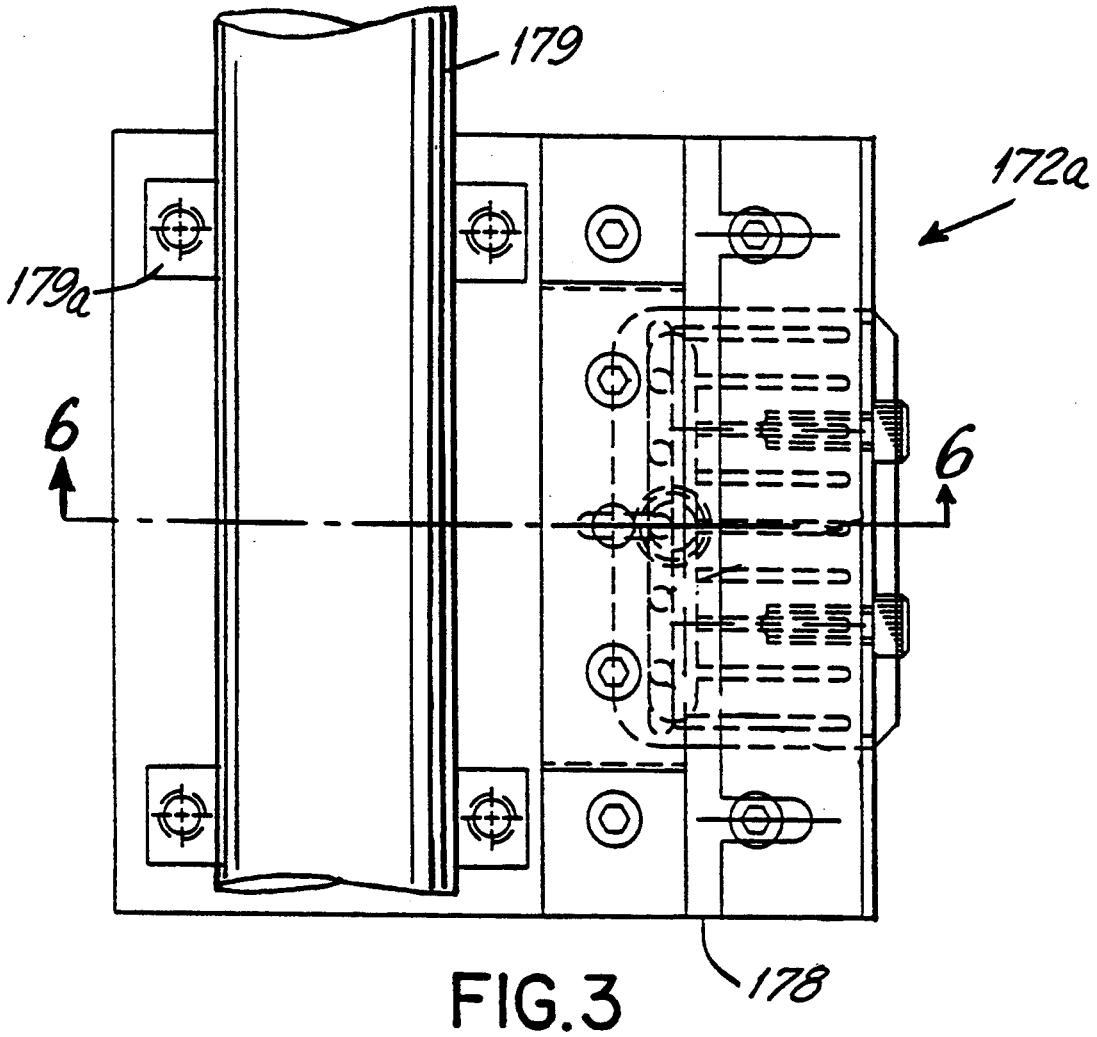
FIG. 3 is a plan view of one embodiment of a solvent wiper assembly.
Figure 4:
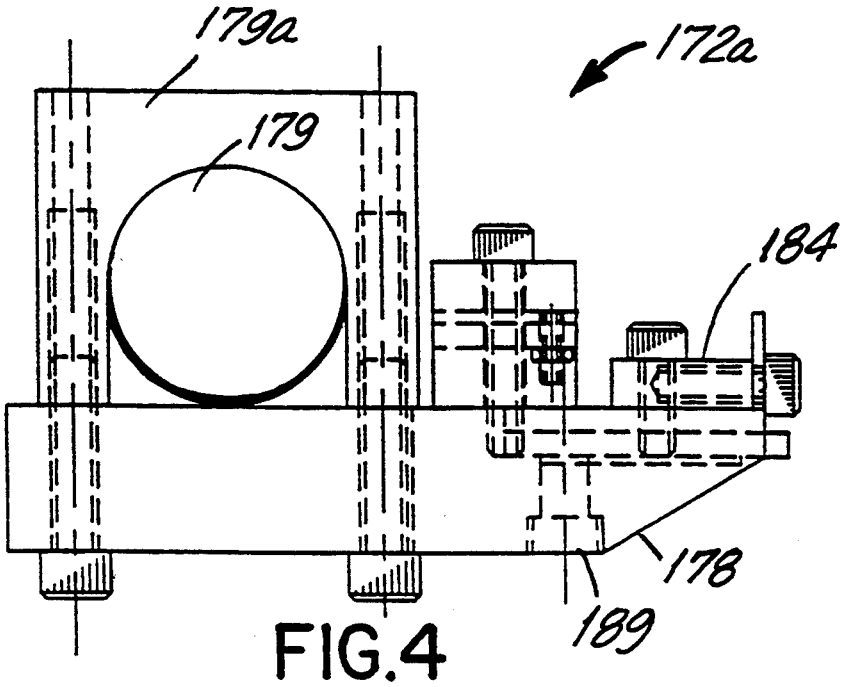
FIG. 4 is a side elevation view of the solvent wiper assembly of FIG. 3.

Each label retaining insert plate 100 is substantially rectangular configured and has a top surface 102 that is configured substantially similar to the curvature of the drum surface (FIGS. 2 and 11). The undersurface of each insert plate 100 includes two plenums formed in the surface. A first plenum 104 is formed on the undersurface and has orifice holes 106 (FIG. 13) extending upward to communicate with the surface of the label retaining insert plate 100 at the area where the leading edge of the label is positioned.

The first plenum 104 includes a port 110 which is positioned in circumferential alignment with a circumferentially extending, slotted vacuum manifold 112 formed in the hub opposing the inside surface of the label drum 50 (FIGS. 11 and 11*a*). Vacuum is drawn through a central horizontally extending vacuum supply manifold 112*a* which communicates with the vacuum manifold 112. Seals 113 between the drum and hub prevent air and vacuum leakage.

The vacuum drawn in the vacuum manifold retains the leading edge of the label on the surface of the drum as the drum initially rotates after a cut label has been applied thereto. The port 110 is aligned over the vacuum manifold so vacuum is drawn through the port 110 and plenum 104 until the label reaches the article wrapping position 21. At that point, the port 110 is positioned over a pressure manifold 114 which exerts air pressure supplied from a horizontal manifold 114*a* against the leading edge of the label to help push the label against an article. FIG. 11*a* shows the port 110 aligned over the pressure manifold 114.

A second plenum 120 is formed in the undersurface of each label retaining insert plate 100 and has orifices 122 extending therethrough to communicate with the surface of the insert plate 100 at an area where the trailing edge and midportion of the label are positioned. This second plenum includes a port 124 which is aligned circumferentially with a second circumferentially extending, slotted vacuum manifold 126 (FIGS. 11 and 11*a*) formed in the hub to retain the trailing and midportion of the label thereto. The second vacuum manifold 126 starts from a position offset but parallel to the first vacuum manifold 112 and extends past the first vacuum manifold and pressure manifold 114 defining the article wrapping position 21 (FIG. 11).

The second vacuum manifold retains the label onto the drum if the leading edge does not engage an article to be transferred thereto. If the leading edge does engage an article and is transferred, vacuum draw between the label and drum surface is broken intermittently as the label is rolled upward on the article, similar to opening a "sardine can". A blow-off manifold 128 provides pressure for blowing off labels that have not been transferred, but retained onto the drum surface such as occurs when an article misfeeds (FIG. 11*a*).

A slot 130 is formed in the upper surface of the insert plate 100 and extends transversely across the plate in a position where the area adjacent the trailing edge of a label is positioned on the plate. (FIGS. 2 and 9 through 11 and 14). A longitudinally extending, spring biased plunger 132 is positioned in the slot 130 and biased upward so that the plunger engages and biases upward the area adjacent the trailing edge of the label positioned on the insert plate 100.

As shown in greater detail in FIG. 10A, the plunger 132 has an end portion with an upwardly inclined surface 133 in the direction of drum rotation and a substantially flat, land portion 133*a* following the upwardly inclined surface 133. The upwardly inclined portion 133 can be formed such as by grinding, thus forming with the land portion 133*a* a crown-type configuration in the direction of drum rotation. It is possible for the inclination to be reversed, but better solvent wiping has been found to occur when the incline is in the direction of drum rotation.

The angle of inclination of surface 133 is typically about 15° to 30° but can vary widely. In one embodiment, the plunger is about 0.10 to 0.25 inches wide, with a land area of about 0.010 to about 0.08 inches wide, and more preferably a 0.125 inch wide wiper with a 0.03 inch wide land area. The novel plunger configuration provides for a more narrow solvent wipe onto the trailing edge of the label, yet has a wide enough land 133*a* dimension to provide a good solvent wipe. It has been found that the more narrow wipe reduces mottling of solvent on the label.

Each insert plate 100 also has a resilient surface formed from a material such as a rubber insert 134 placed over a substantial portion of the outer surface of the plate (FIGS. 2 and 10). The orifices and slot 130 are formed also within the rubber insert 134. The rubber insert 134 forms a soft cushion on which the article rolls during wrapping. Because the rubber acts as a cushion, the article is deflected slightly into the cushion material during wrapping by means of a pressure applicator 22 (FIG. 11) so as to create a "footprint" in the soft, cushion material.

The pressure applicator 22 imparts a desired pressure onto selected areas of the sides and ends of the article during wrapping to ensure end-to-end alignment of the wrapped labels and prevent mismatching of the label during wrapping. During wrapping, the air is squeezed out between the article, label, and drum surface, allowing better wrapping of the label about the article. During wrapping, the plunger 132 is biased inward by the article so that the plunger does not interfere with the article, label and drum surface.

Figure 13:
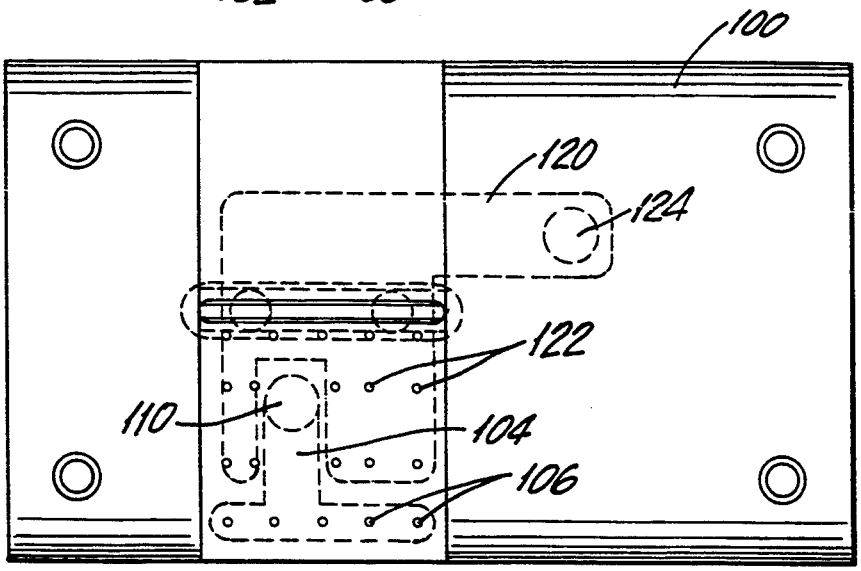
FIG. 13 is a plan view of a label retaining insert plate.

As best shown in FIG. 13, the portion of the label retaining insert plate adjacent the plunger 132 and opposite the area where the midportion of a label rests is void of orifices. As a result, no vacuum is drawn at the very trailing edge of the label, and the plunger moves unimpeded without having to overcome the vacuum draw pulling the trailing edge of the label downward. Additionally, it is believed that at times solvent will leak around the trailing edge and into the orifices.

The drum also includes six label surface plates 136 (FIGS. 2 and 11) positioned respectively between label retaining insert plates 1100. Each surface plate includes a resilient surface insert 138 such as formed from rubber or other similar material. The rubber insert surfaces 134 and 138 form a continuous resilient, rubber surface on the label transport drum which also increases the friction between the article, label and drum surface. As a result, less pressure can be exerted by the pressure applicator 22 during article wrapping. The reduced pressure creates a clearer seam during article wrapping without having excess solvent squeezed out of the seam causing uneven mottling in areas adjacent the seam.

As shown in FIG. 10, details of the off-drum cutting assembly 140 are illustrated. Although the description will refer to one cutting mechanism, different cutting mechanisms can be used which provide the means for cutting the labels and transferring the labels onto the label transport drum. The off-drum cutting assembly 140 includes a cutting drum indicated generally at 142 having an outer drum 144 and inner manifold hub 146 with respective vacuum and pressure manifolds 147, 148 formed therein. Ports 150 positioned on the outer drum operatively communicate with the vacuum and blow-off manifolds. The vacuum manifold 147 extends from a position where the film strip is initially supplied onto the cutting drum to a transfer position 151. The pressure manifold begins at the transfer position 151. The cutting drum operates similar to the label transport drum in that the cutting drum first retains the film and then applies pressure to the pressure manifold to transfer the label onto another cylindrical surface, i.e., the label transport drum.

The cutting drum 142 has a circumference that is equal to one pitch of the label transport drum 20, i.e., in the illustrated embodiment nine inches corresponding to the six pitches of the label transport drum 20. The cutting drum 142 is gear driven at a six-to-one ratio directly from the label transport drum 20. As the label transport drum 20 completes one revolution, the cutting drum 142 completes its sixth revolution.

As the label film is advanced by the film feed rollers, it travels over the idler roll 39*a* to bring the film into tangential contact with the cutting drum surface. At the contact point between the cutting drum 142 and the film, the internal vacuum to the cutting drum 142 retains the film to the drum surface. The outer periphery of the cutting drum surface is advanced one revolution, i.e., about nine inches. The film however, is advanced only one label length (about two inches for an "AA" size battery) by the servomotor system which helps feed the film label. This speed differential causes the metered film to slip on the surface of the rotating cutting drum 142.

The cutting drum 142 includes a cutting blade 154 which protrudes outward from the drum surface. A stationary cutting blade 156 is fixed onto the frame 22 and spaced outward a small distance from the cutting drum periphery and this position defines a cutpoint where the film is cut. As the cutting drum 142 rotates, the cutting blade 154 engages the fixed cutting blade 156 to cut the film at its margin between respective printed indicia. Typically, the cut point is positioned so that the leading edge of the label is positioned over the pressure manifold and is forced outward onto the cutting drum. The vacuum retaining the label on the drum is progressively broken as the cut label moves with the rotating cutting drum. Because the drive ratio and diameter/circumference relationship between the label transport drum 20 and cutting drum 142 are substantially constant, both rotate at the same surface speed, and label transfer from the cutting drum to the label transport drum occur at a precise position each time corresponding to the label retaining insert plates 100.

The feedback incremental encoder on the shaft of the label transport drum feeds information to the controller 39 concerning position and velocity of the label transport drum. The servomotor feed system is the "slave" and makes corresponding adjustments of film feed based on the signals detected from the registration sensor 36 which is also operatively connected to the controller 39, and the encoded position and velocity of the label transport drum.

As the vacuum secured label moves with the rotating label transport drum 42, the leading edge of the label advances to an adhesive applying position adjacent to an adhesive applicator, indicated generally at 160 (FIG. 1). One type of applicator, which can be used is described more fully in the copending parent application Ser. No. 07/906,573. The adhesive applicator 160 applies adhesive by printing the adhesive to the area adjacent the leading edge 21*a* of the label. In a preferred embodiment, the adhesive applicator includes a rotary pad print head 162 which is timed to rotate at a fixed speed with the label transport drum. The print head 162 includes an outwardly extending adhesive print pad 164. The print pad 164 typically is rectangular configured, and include a pad face which engages the label. The pad 164 can be formed from a strip of resilient rubber, silicone or other material. The print pad 164 engages a rotating gravure roller 166 which transfers the adhesive to the print pad 164. The depth of indentations in the gravure roller 166 determine the amount of transferred adhesive. The gravure roller 166 engages an adhesive supply as is customary in the art. The print head 162 is timed to rotate with the label transport drum such that the print pad 164 engages the trailing edge of the label at the same surface speed of the drum so that the adhesive is "printed" against the leading edge of the label.

As noted in the foregoing copending '573 patent application, a cold adhesive is more desirable than a hot melt adhesive because a hot melt adhesive tends to distort the thin label material, such as may occur if the method and apparatus that are disclosed in U.S. Pat. No. 4,844,760 to Dickey were used with a hot melt adhesive. As used herein, the term cold adhesive is defined as those adhesives that are viscous at room temperature, as compared to conventional hot melt adhesives that are inherently solid at room temperature and become viscous only at elevated temperatures. Potential cold adhesives could be water or solvent based adhesives with suspended solids, and potentially rubber-based solvent and latex adhesives. Other adhesive applicator mechanisms also could be used as long as adequate adhesive is neatly and aesthetically printed according to manufacturing and quality guidelines. Because the adhesive is a "cold" adhesive, it is "printed" by a print head rotating at substantially the same surface speed as the label transport drum.

After the cold adhesive is applied to the area adjacent the leading edge of the label, a solvent application system, indicated generally at 170 (FIGS. 1 and 2), evenly applies solvent without mottling or solvent streaking in a precise pattern to the area adjacent the trailing edge of the label. The preferred solvent is an organic solvent and reacts to the film material. THF has been found to be an acceptable solvent.

The solvent reacts with the film material, dissolving a portion of the area adjacent the trailing edge to provide a tacky quality to that area, so that the trailing edge can be retained to the leading edge by a solvent-seal bond when the label is circumferentially wrapped around the article and the trailing edge overlaps the leading edge.

The solvent is preferably applied after the adhesive is applied, to ensure that the solvent does not evaporate before the trailing edge of the label has overlapped the leading edge. As illustrated, the solvent application system 170 is positioned ahead of the adhesive applicator 160 in the direction of drum rotation so that the label first engages the adhesive applicator 160, then the solvent application system 170. This arrangement is preferred as compared to the reverse arrangement disclosed in the drawings of the copending parent application where the adhesive applicator is positioned after the solvent applicator, similar to the system in the Dickey '760 patent.

Figure 6:
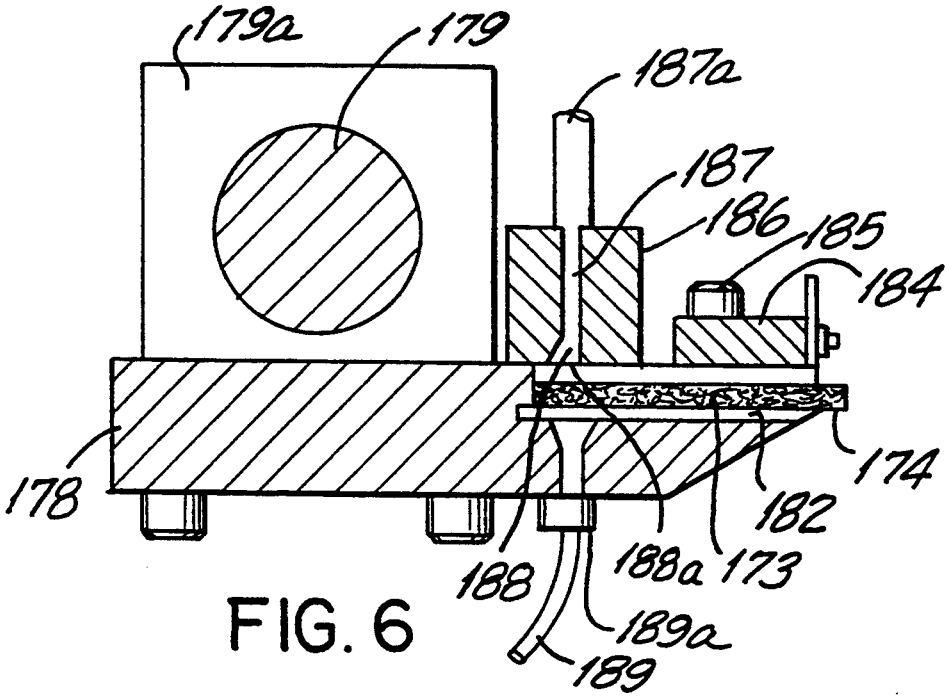
FIG. 6 is a side sectional view of the solvent wiper assembly taken along line 6—6 of FIG. 3.

In the preferred, illustrated embodiment of FIG. 1, the solvent application system 170 includes two static wiper assemblies 172*a*, 172*b*, which are constructed similar to each other (FIGS. 1 through 4, and 8). Each assembly supports a wiper body 173, having an outwardly extending wiper tip 174 (FIG. 6). In the illustrated embodiment, the wiper body is substantially rectangular configured with one end forming a wiper tip. The wiper tip can be thinner than the wiper body, tapered toward the end, or formed as another configuration such as a thin print pad as long as it is operable to apply solvent in a high quality wipe. The wiper body is preferably formed from felt or other similar porous material that absorbs solvent and then allows the solvent to flow to the wiper tip, such as by capillary action. The felt is also not reactive to the solvent.

The first wiper assembly 172*a* cleans the trailing edge of the label—removing dirt and softening the trailing edge, by applying an amount of solvent sufficient only to clean and soften the area adjacent trailing edge of the label. The first wiper assembly acts as a pretreat to the label that "etches" the label for further application of more solvent from the other wiper.

The second wiper assembly 172*b* applies the solvent that "bites" into the film so as to dissolve the solvent and form a tacky quality to the label and provide the welding action needed to secure the trailing edge in overlapping, secured solvent-seal relationship to the leading edge of the label when the label is wrapped about an article.

This two wiper assembly system is beneficial because the solvent applied by each wiper can be the same as or different from each other. The solvent in the first wiper can be a solvent having the characteristics of cleaning, while the solvent in the second wiper has characteristics of dissolving the polymer label for later forming a solvent-seal bond. Although the amount of applied solvent varies between the first and second wiper assemblies, it has been found sufficient that about twice as much solvent can be applied by the second wiper assembly than the first wiper assembly to first clean and soften the label, then form a tacky quality for a solvent-seal bond when the same solvent such as THF is used.

Figure 5:
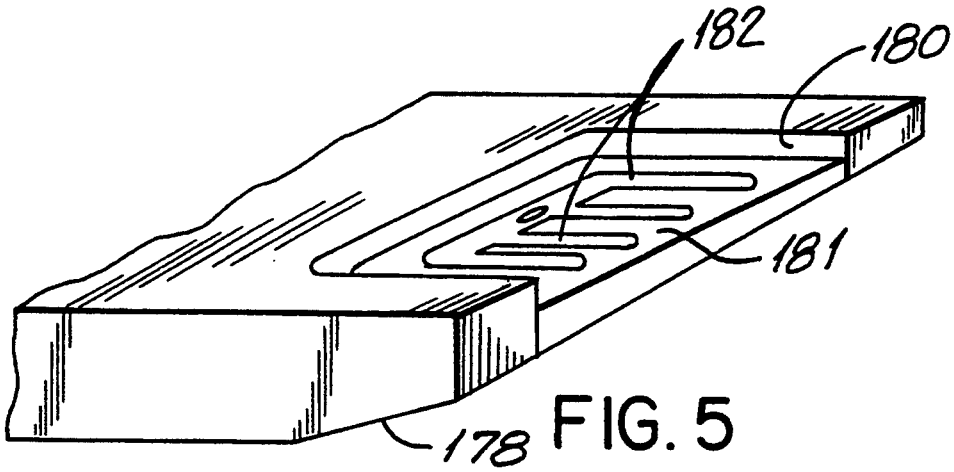
FIG. 5 is a schematic isometric view of one embodiment of the wiper body support block.
Figure 8:
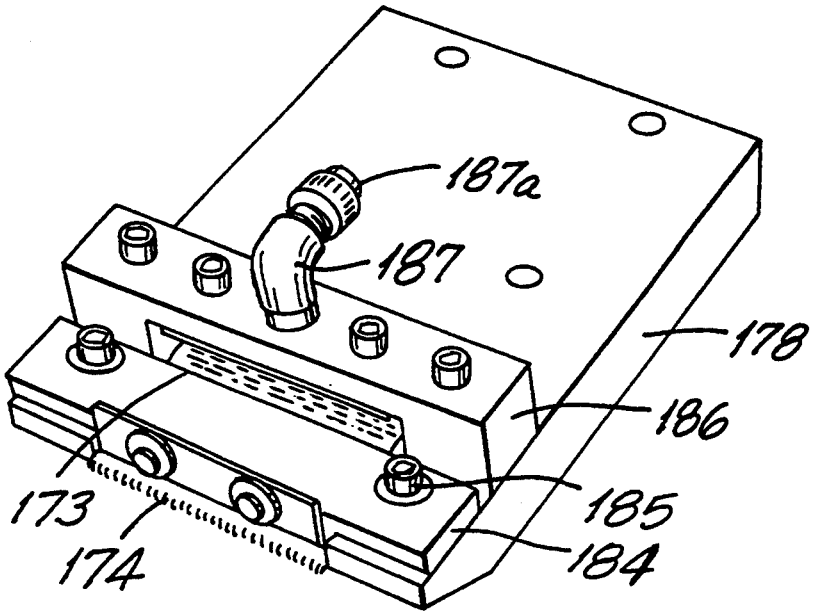
FIG. 8 is an isometric view of the solvent wiper assembly.

Each wiper assembly 172*a*, 172*b* is formed from a support housing structure which supports the wiper body 173. The support housing structure includes a lower, substantially rectangular configured support block 178 (FIGS. 5 and 8). A wiper assembly support shaft 179 is secured at one end to the machine frame, and extends through parallel mounting blocks 179*a*, which are secured to the top surface of the support block 178 (FIGS. 2 and 6). The mounting blocks 179*a* are free to rotate on the support shaft 179. The wiper assemblies can thus be pivoted into and out of a wiping position as desired.

The upper surface of the support block 178 includes a formed cutout 180 (FIG. 5), which is configured for receiving the wiper body 173 therein on a wiper body support surface 181. The cutout 180 is formed open to the surface. A solvent channel 182 (FIG. 5) is formed on the wiper support surface 181 to receive solvent from the wiper body. A rectangular configured wiper retaining block 184 is secured by fastening means such as allen nuts 185 to the front portion of the support body 178 and engages the wiper body to retain the wiper body within the cutout area 180.

Figure 7:
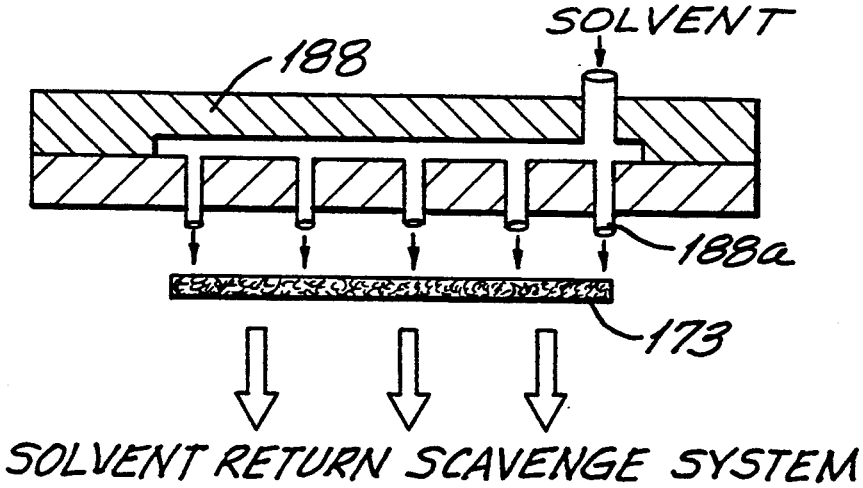
FIG. 7 is a highly schematic view illustrating drip feed of solvent onto the wiper body.

A solvent delivery block 186 is positioned on top of the support block 178 and includes a solvent delivery fitting and orifice 187 which connects to a solvent delivery line 187*a*. The solvent delivery fitting and orifice 187 extends through the solvent delivery block 186 into a plenum 188 which has solvent delivery ports 188*a* open at one end (FIG. 7) so that solvent delivered through the solvent delivery line 187*a* is drip fed by gravity through the ports 188*a* onto the wiper body 173. A return line 189 is connected to a return line bore 189*a* which extends upward through the support block to communicate with the solvent channel 182.

Figure 9:
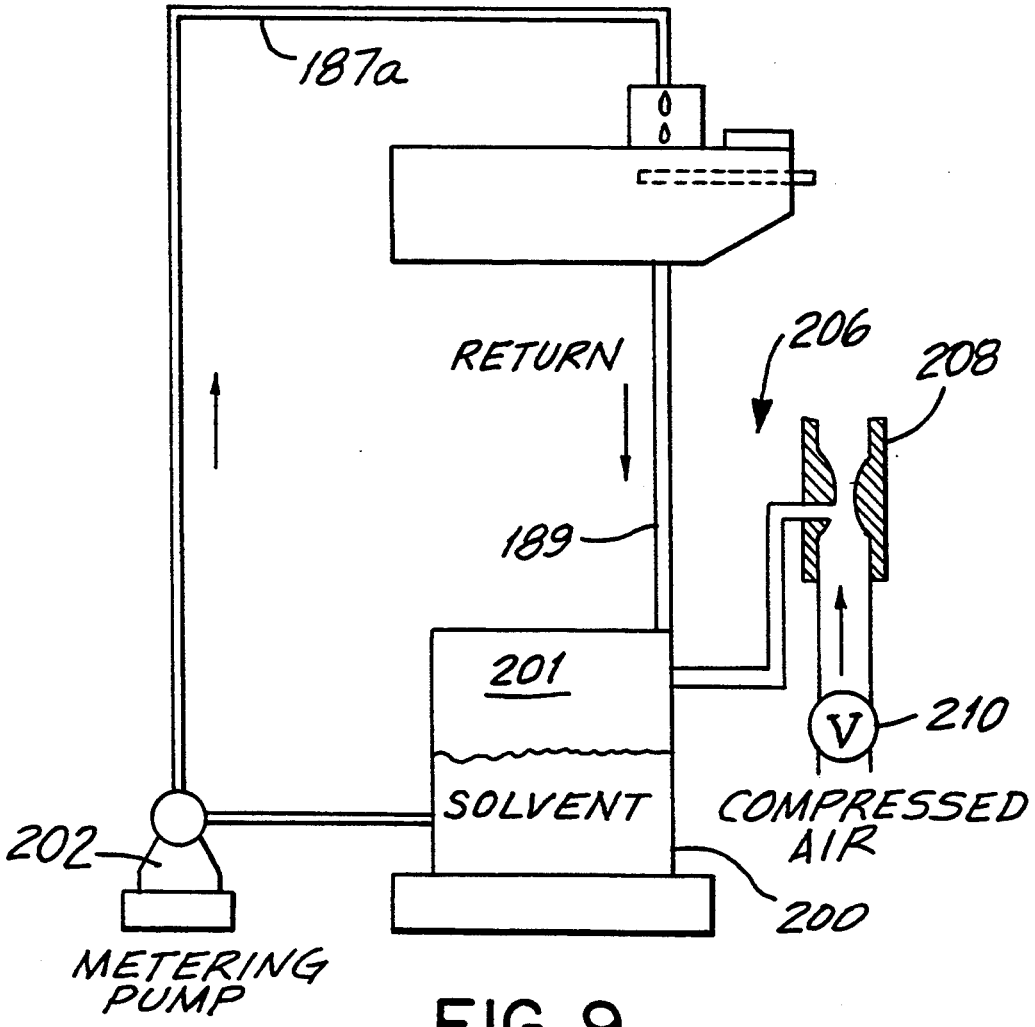
FIG. 9 is a schematic illustration showing the solvent delivery system.

Referring now to FIG. 9, details of the solvent delivery system and vacuum scavenge systems are illustrated. In the preferred embodiment, each solvent wiper assembly 172*a*, 172*b* includes its own delivery system and vacuum coverage system so that each wiper assembly is separately supplied with solvent.

Solvent is contained in the closed reservoir 200. Typically, the reservoir 200 is about half full and forms a vacuum head space 201 within the reservoir. A metering pump 202 draws solvent from the reservoir 200 and through the solvent delivery line 187*a* to the wiper assembly where the solvent is drip fed onto the wiper body. The solvent return line 189 connects to the top of the reservoir 200 in sealed relation thereto. A vacuum draw system, indicated at 206, is operatively connected to the solvent reservoir and applies a scavenge vacuum to the reservoir for regulating the subatmospheric pressure within the reservoir. As subatmospheric pressure within the reservoir is varied, the wiper body becomes more or less saturated as desired.

As shown schematically in FIG. 9, the vacuum draw system 206 includes a venturi 208 through which air flow is metered by means of a valve 210. A vacuum take-off line 212 extends form the venturi 208 to the closed reservoir. As the air pressure flowing through the venturi is varied, the subatmospheric pressure in the reservoir 200 is varied. If more air passes through the venturi, subatmospheric pressure within the reservoir is lowered, causing the wiper body to become drier, thus reducing the amount of solvent at the tip. Less solvent would be transferred to the tip.

Another type of scavenge vacuum system which may be used is disclosed in U.S. Pat. No. 4,844,760 to Trine, which is hereby incorporated by reference. It is possible to vary solvent in the wiper body from fully saturated to fully dry by varying subatmospheric pressure within the reservoir 200.

The solvent application system in another less preferred embodiment is illustrated schematically in FIG. 1A as 170′, and includes a wiper member, indicated generally at 220, formed as a rotary printing head 222 that is mounted for rotation adjacent the label transport drum. The rotary printing head 222 includes two outwardly extending, flexible tips 224 that taper outward. The tips 224 are formed from a resilient material that is not highly reactive to the solvent. The flexible tips 224 are resilient to allow deflection of the tip against the label and drum surface, while retaining at least some stiffness to exert a wiping force against the label. Materials which may be used include felt, a cloth covering a felt wiper member, a soft cord, some silicones and urethanes, as well as other materials that are not highly reactive to the solvent, but have appropriate resilience for a rotating wiper.

In accordance with that illustrated embodiment, the wiper tip 224 is rotated at a surface speed different from the surface speed of the rotating label transport drum. The wiper tip 224 is timed in rotation with the label transport drum so that the wiper tip engages the area adjacent the trailing edge of the label 224. The solvent, such as THF, is about half as viscous as water, and the speed differential between the wiper tip and label transport drum has been found to be beneficial in controlling solvent application and in applying solvent adjacent to, but spaced from the leading edge.

After solvent application and during label wrapping, the article rolls back over the solvent penetrated area of the label, and the article weight pushes the solvent back across that area to the trailing edge of the label. This rolling motion across the solvent penetrated area has the effect of producing two wipes with each one wiper tip application, causing a more even spreading of solvent. The speed differential can be obtained by using a servomotor or elliptical gear arrangement. One elliptical gear is connected to the shaft of the rotary pad print head and the other elliptical gear is connected to the shaft of the label transport drum 20. The elliptical gears mesh with each other.

The elliptical gears could be bi-lobed elliptical gears with a "k" factor of two, i.e., having a relationship between the major foci radius and minor foci radius is two to one. This "k" factor produces a speed differential which reaches its maximum at four points per gear revolution. Two of these points produce an end motion of the wiper tip that is faster than the surface speed of the label transport drum, while the other two produce a surface speed of the wiper tip that is slower than the label transport drum. The average of all four points produce a wiper speed that is equal to that of the label transport drum.

By timing the maximum speed differential at the time the wiper tip is in contact with the trailing edge of the label, a wiping action can be produced. If the wiper tip is moving slower than the label transport drum, the solvent is wiped toward the trailing edge of the label. Conversely, if the wiper tip is moving faster than the label transport drum, the solvent is wiped from the trailing edge of the label forward. By timing the occurrence at the maximum speed differential points, the amount of wiping action can be varied. The gears can also be set to yield an applicator surface speed equal to that of the label transport drum.

In another embodiment of a rotary wiper assembly not illustrated in detail, the wiper assembly could include multiple wiper tips with a solvent delivery system formed as a port on the assembly. The assembly could include six evenly spaced wiper tips. The solvent applicator could be driven from the wrap drum at a 1:1 gear ratio. As the wrap drum advances one pitch, the wiper tip also advances one pitch. The pitch of the label transport drum is nine inches whereas the pitch of the wiper assembly is three inches. This difference in pitch will produce a wiping action at the point of contact between the label transport drum and the wiper tip.

Solvent could be supplied to a rotary wiper from one of two methods. The solvent may be supplied by means of a gravity tube from a raised solvent reservoir or it may be fed by a commercially available metering pump. Either means of supply can be fitted with a needle type metering valve to restrict solvent flow. At each of the six wiper tip areas, provisions could be made to further individually restrict the flow of solvent by means of a chemically resistant, resilient supply tube. This supply tube may be constricted by means of a pressure applying screw. After the solvent passes through the supply tube, it would reach an internal distribution cavity which would allow the solvent to be dispersed over the entire width of the applicator pad. Once the solvent contacts the applicator pad, it would wick to the outer surface of the pad where it is transferred to the trailing edge of the label upon contact.

As noted before, the rotary wiper producing the speed differential is not the preferred embodiment. The speed differential between a wiper tip and label moving with the drum is maximized with the use of the static wiper assemblies 172*a*, 172*b* as described above.

METHOD OF OPERATION

In operation a strip 28 of label material is fed from the label supply roll 26*a*, through the dancer roll assembly 32 and into the off-drum cutting mechanism 42 (FIG. 1). As the drum rotates, the cut label is transferred to the drum surface on the label retaining insert plates 100. The vacuum drawn within the first and second vacuum manifolds 114, 126 is drawn through the first and second plenums 104, 120 and orifices 106, 122 to retain the label on the drum surface. The controller 39 is operatively connected to the servo motors of the feed rolls 38, the registration sensor 36, and label transport drum encoder, to provide constant film withdrawal speed during operation without intermittent film feed, thus minimizing motor spikes and inaccurate start-stop operation.

As the label moves with the drum 20, the label moves opposite the adhesive applicator 160 where an adhesive is printed onto the area adjacent the leading edge 21*a*. As the drum continues its rotation, the trailing edge moves adjacent the wiper members. The spring biased plunger 132 has pushed the trailing edge of the label outward from the drum surface. As a result, the outwardly biased trailing edge of the label engages the outwardly extending wiper tips 174, so as to apply a predetermined amount of solvent on the trailing edge of the label. The spring which biases the plunger 132 may be variable so that differing degrees of pressure must be applied to depress the plunger based on parameters such as the type of article to be wrapped and the size of the label.

As shown in greater detail in FIG. 1, the articles A are initially conveyed on a flat belt conveyor 230 and into a star transfer wheel 232. The star wheel 232 rotates, transferring the articles A one at a time into an inclined belt conveyor 234 to provide a sufficient head of articles for process flow control. The articles can be fed in a double row, side-by-side manner, each pair of articles having complementary pairs of labels to be applied thereto. For purposes of illustration, the figures show only one row of fed articles—the other row of slots on the article transfer wheels being empty. The apparatus can be readily designed for working with either one or two rows of fed articles.

The belt conveyor transports the articles A into an inclined gravity chute 236 having a serpentine channel 238 for slowing the movement of the articles A downward from the height of the inclined belt conveyor. Articles A then are fed into a serpentine timing wheel assembly, indicated generally at 240, where a tangential, rotative movement is imparted to the articles A. The articles A traverse around the serpentine timing wheel assembly 240, which includes three transfer wheels 240*a*, 240*b*, 240*c* mounted on spindles connected to the frame (FIG. 2). Each transfer wheel has article carrying positions 242 (FIG. 2) for holding and conveying the articles.

The transfer wheels accelerate movement of the articles into contact with the surface of the drum. As the article leaves the third transfer wheel 240*c*, the article engages the entrance portion of a downwardly inclined pressure plate 246 of the pressure applicator 22 which imparts a spin to the article to move the article into tangential spinning engagement with the surface of the label transport drum 20 (FIG. 2). The articles A traverse along the drum surface, held to the surface by means of the pressure plate 246, which also acts as a retaining shield. The label transport drum 20 rotates faster than the spinning articles, imparting and maintaining spin to the articles A. Because the drum is rotating faster than the spinning articles A, the leading edge of the label moves into engagement with an article A at the article wrapping position 21.

At the article wrapping position 21, the leading edge of the label is blown upward away from the drum surface by means of pressurized air blowing from the first pressure manifold 114 and through the orifices 106 of the label retaining insert plate 100. The adhesive on the leading edge forms a "tack" bond on the article, tack bonding the label to the article.

As the article rolls, the label is rolled upward against the body of the article and the vacuum seal between the label L and the surface of the drum is broken. Thus, the vacuum drawn in the second vacuum manifold and through the orifices engaging the midportion and trailing edge of the label is broken to allow complete article wrapping. This action is similar to the opening of a "sardine can." If an article misfeeds at the article wrapping position, the leading edge does not engage the article, and the label is retained by the vacuum drawn in the second vacuum manifold 126 to the drum surface past the article wrapping position 21. The label continues moving with the rotating drum into a label blow-off position where the vacuum holding the label to the drum surface ceases, and a pressurized blow of air onto the label from the pressure manifolds 128 forces the label from the drum surface.

If the labels are mismatched, i.e., the ends are unaligned (FIG. 14A), a control rod assembly indicated generally at 250 (FIG. 2), of the pressure applicator 22 is adjusted to change the camber of the pressure plate 246 engaging the articles to impart the desired pressure against selected sides and ends of the article so that the label is aligned correctly on each article as they are wrapped (FIG. 14B).

As the article continues its rotation around the drum surface, the article then is removed by a serpentine timing wheel assembly, indicated generally at 260, and having three transfer wheels with article engaging slots. The articles then move onto a flighted bed belt conveyor 266, where a laser marker 266*a* marks each article, (i.e. battery) with a code. The conveyor transports the articles into an oven 267 where the articles are heated overall and the label film heat shrunk around the articles A. A manual swing arm assembly 270 supports a modular control unit 272 (FIG. 1) providing access for a user to the machine controls and for programming the controller 39. In another embodiment (not illustrated), the article discharge area is formed from a lug chain, and not a timing wheel assembly.

The smaller size batteries used with the present invention are typically about 1.25 inches in diameter, and about 2.25 inches long for a "D" size battery and about 0.375 inches diameter and about 1.675 inches long for an AAA size battery. The batteries have opposing, substantially planar end portions forming a shoulder 300 at the intersection of the outer peripheral surface of the battery and the end portions. As shown in FIG. 15, the label, before it is wrapped, is substantially rectangular configured with leading and trailing edges (21*a* and 21*b*). A major portion of the label is covered with printed matter and ink 320 (indicated by the central striped pattern). The portions of the label adjacent the leading and trailing edges of the label are substantially void of printed matter and ink. The label portion adjacent the trailing edge has a greater area that is void of printed matter and ink than the portion adjacent the leading edge. The trailing edge portion void of printed matter and ink is typically about 0.10 to 0.25 inches wide.

Typically these dimensions are constant for most battery article sizes such as "AAA" to "D" size batteries. Naturally, the dimensions can vary depending on the article, label, and desired quality. This area receives the solvent without causing ink spread and dissolving such as would occur if the printed matter and ink were continued to the trailing edge of the label. As illustrated, the label and the label areas adjacent the shoulders are heat shrunk over the shoulders. The leading edge includes an adhesive.

A small cylindrical article that has been labeled in accordance with the present invention is illustrated as a size "AA" battery in FIGS. 14A and 14B.

It should be understood that the foregoing description of the invention is intended merely to be illustrative thereof, and that other embodiments, modifications and equivalents may be apparent to those skilled in the art without departing from its spirit.

That which is claimed is:

1. An apparatus for applying thin film, heat shrinkable polymer labels onto small cylindrical articles, comprising a label transport drum having a substantially smooth surface and defining smooth label retention areas on which a cut label is positioned and including vacuum orifices positioned on said smooth label retention areas and means for drawing a vacuum therethrough for retaining a cut label onto the smooth label retention areas as said drum rotates, means for rotating said drum, means positioned adjacent said drum for cutting a strip of thin film, label material into cut labels, means for feeding the cut thin film, heat shrinkable polymer label to the surface of said label transport drum onto a label retention area that has moved opposite the cutting means, means for printing a cold adhesive onto an area adjacent the leading edge of said label while said leading edge of said label is moving with said drum and positioned flat on said label retention area, a porous wiper body having a fixed, outwardly extending wiper tip positioned closely adjacent the peripheral surface of said drum, a narrow width plunger extending into the drum surface at said label retention area where the trailing edge of a label is positioned, said plunger having a length which extends across the width of the label retention area so as to engage substantially the full width of the trailing edge of the label, wherein the length of the plunger across the width of the label retention area is substantially greater than the width of the plunger, means for biasing said plunger outward from the drum surface so as to extend a narrow part of the label defined by its trailing edge outward from the label retention area, wherein said plunger extends the leading edge of the label a distance outward from the drum surface sufficient so that the trailing edge of the label engages the wiper tip, means for applying solvent onto the wiper body for dispersion throughout and to the wiper tip, means for conveying small cylindrical articles into tangential spinning engagement with said drum and into rotative engagement with said leading edge of said label as said label is moved into engagement with said rotating article so that said label wraps about the article and is bonded thereto, and wherein said biasing means on said plunger exerts an outwardly biased force of a magnitude such that said article during wrapping forces the plunger inwardly so that the article is wrapped on the smooth label retention area.

2. An apparatus according to claim 1 including heater means for heat shrinking the label onto the article.

3. An apparatus according to claim 1 wherein said means for applying solvent onto the wiper body includes an enclosed solvent reservoir, means for pumping solvent from the solvent reservoir onto the wiper body, a substantially planar support surface supporting said wiper body, said support surface including means for collecting solvent from said wiper body, and a return line connected to said collection means and said solvent reservoir for returning solvent to said reservoir.

4. An apparatus according to claim 3 including means for drawing vacuum within the closed reservoir and for regulating subatmospheric pressure within the reservoir for controlling solvent saturation in the wiper body.

5. An apparatus according to claim 4 wherein said means for drawing a vacuum and for regulating subatmospheric pressure comprises a venturi, means for blowing air through said venturi, and a vacuum take-off line extending from said venturi to said closed solvent reservoir so that subatmospheric pressure within said closed reservoir is varied as the amount of air flowing through said venturi is varied.

6. An apparatus according to claim 1 wherein said plunger includes and end portion having an upwardly inclined surface in the direction of drum rotation and a substantially flat, land portion following the upwardly inclined surface.

7. An apparatus according to claim 1 wherein the surface of said drum is resilient for increasing friction between said article, label and drum surface during wrapping and allowing slight deflection of said article into said resilient material.

8. An apparatus according to claim 1 wherein said means for printing a cold adhesive onto the surface of said drum comprises a rotatable print head having a print pad for engaging the leading edge of the label, and means for rotating the print head at substantially the same surface speed as the label transport drum.

9. An apparatus according to claim 8 including a gravure roll for engaging said print pad and transferring adhesive onto said print pad.

10. An apparatus according to claim 1 wherein said cold adhesive is viscous at room temperature.

11. An apparatus for applying a thin film heat shrinkable polymer label onto small cylindrical articles comprising a label transport drum having a substantially smooth surface, and defining smooth label retention areas on which a cut label is positioned and including vacuum orifices positioned on said smooth label retention areas and means for drawing a vacuum therethrough for retaining a cut label onto the smooth label retention areas as said drum rotates, means for rotating said drum, means positioned adjacent said drum for cutting a strip of label material into cut labels, means for feeding the thin film, heat shrinkable, polymer label to the surface of said label transport drum, onto a label retention area that has moved opposite the cutting means, means for applying an adhesive onto an area adjacent the leading edge of said label while said label with moving with said drum, first wiper means for wiping label reactive solvent onto the area adjacent the trailing edge of the label in an amount sufficient for cleaning and softening the area adjacent the trailing edge without dissolving of the label and, second wiper means for wiping a label reactive solvent onto the area adjacent the trailing edge of the label in an amount substantially greater than applied by said first wiping means for dissolving the label and forming a tacky quality thereto, said wiper means having an outwardly extending wiper tip positioned adjacent the peripheral surface of said drum, means for applying solvent to said wiper tips, a narrow width plunger extending into the drum surface at said label retention area where the trailing edge of a label is positioned, said plunger having a length which extends across the width of the label retention area so as to engage substantially the full width of the trailing edge of the label, wherein the length of the plunger across the width of the label retention area is substantially greater than the width of the plunger, means for biasing said plunger outward from the drum surface so as to extend a narrow part of the label defined by its trailing edge outward from the label retention area, wherein said plunger extends the leading edge of the label a distance outward from the drum surface sufficient so that the trailing edge of the label engages a wiper tip, and wherein said plunger is retractable into said drum and said biasing means exerts such force so that as an article engages the trailing edge of the label at an article wrapping position, the article pushes the trailing edge downward into a plane coextensive with the peripheral surface of said drum so that said article rolls on a smooth surface during wrapping.

12. An apparatus according to claim 11 wherein said plunger includes an end portion having an upwardly inclined surface in the direction of drum rotation and a substantially flat, land portion following the upwardly inclined surface.

13. An apparatus according to claim 11 wherein the surface of said drum is resilient for increasing the friction between the label, article and drum surface and for allowing slight deflection of said article into said resilient material during article wrapping.

14. An apparatus according to claim 13 including a slot positioned on the drum surface inset for receiving said plunger.

15. An apparatus according to claim 11 wherein said adhesive is a cold adhesive which is viscous at room temperature.

16. An apparatus according to claim 11 wherein said first label reactive solvent is the same as the second label reactive solvent.

17. An apparatus according to claim 11 wherein said second label reactive solvent is different from the first label reactive solvent.

18. A method of applying a heat shrinkable film polymer label into a small cylindrical article cutting a strip of label material into labels, and feeding the cut heat shrinkable, thin film polymer labels onto the surface of a rotating label transport drum having a substantially smooth surface, and defining smooth label retention areas on which a cut label is positioned, while maintaining the label on the drum by drawing a vacuum through vacuum orifices positioned at the label retention areas, printing a cold adhesive onto an area adjacent the leading edge of the label, and applying solvent onto the area adjacent by trailing edge of the label by:

1) biasing the trailing edge of the label outward from the periphery of the label transport drum, by moving outward form the drum surface a narrow width plunger that extends into the drum surface at the label retention area where the trailing edge of a label is positioned, the plunger having a length which extends across the width of the label retention area which is substantially greater than the width of the plunger, wherein the narrow part of the label defined by its trailing edge is engaged by the plunger, 2) rotating the drum while moving the outwardly biased trailing edge of the label into engagement with a wiper tip spaced outward from the drum periphery and on which solvent has been applied, and 3) conveying small cylindrical articles into tangential spinning engagement with the surface of the drum and into rotative engagement with the leading edge of the label as the label is moved into engagement with the rotating article so that the label wraps about the article and a solvent-seal bond is created, wherein the article pushes the trailing edge downward into a plane coextensive with the drum surface.

* * * * *

UNITED STATES PATENT AND TRADEMARK OFFICE

CERTIFICATE OF CORRECTION

PATENT NO. : 5,401,353

DATED : March 28, 1995

INVENTOR(S) : Ian Westbury
M. Galchefski

It is certified that error appears in the above-indentified patent and that said Letters Patent is hereby corrected as shown below:

At Column 10, line 1, change "1100" to –100– and after "plate" add –136–.

At Column 18, claim 6, line 64, change "and" to –an–.

Signed and Sealed this

Twenty-seventh Day of June, 1995

*Attest:*

Bruce Lehman

BRUCE LEHMAN

*Attesting Officer*

*Commissioner of Patents and Trademarks*